US011430460B2

(12) United States Patent
Hou

(10) Patent No.: US 11,430,460 B2
(45) Date of Patent: Aug. 30, 2022

(54) METHOD AND DEVICE FOR PROCESSING AUDIO SIGNAL, AND STORAGE MEDIUM

(71) Applicant: BEIJING XIAOMI PINECONE ELECTRONICS CO., LTD., Beijing (CN)

(72) Inventor: Haining Hou, Beijing (CN)

(73) Assignee: Beijing Xiaomi Pinecone Electronics Co., Ltd., Beijing (CN)

( * ) Notice: Subject to any disclaimer, the term of this patent is extended or adjusted under 35 U.S.C. 154(b) by 0 days.

(21) Appl. No.: 17/218,086

(22) Filed: Mar. 30, 2021

(65) Prior Publication Data

US 2021/0398548 A1 Dec. 23, 2021

(30) Foreign Application Priority Data

Jun. 22, 2020 (CN) ..... 202010577106.3

(51) Int. Cl.
*G10L 21/0232* (2013.01)
*G10L 25/18* (2013.01)
(Continued)

(52) U.S. Cl.
CPC ..... *G10L 21/0232* (2013.01); *G10L 25/18* (2013.01); *H04R 1/406* (2013.01);
(Continued)

(58) Field of Classification Search
CPC ..... G10L 21/0232
See application file for complete search history.

(56) References Cited

U.S. PATENT DOCUMENTS

2007/0025556 A1* 2/2007 Hiekata ..... G10L 21/0272 381/17
2021/0183351 A1 6/2021 Hou
(Continued)

FOREIGN PATENT DOCUMENTS

CN 111009256 A 4/2020
CN 111009257 A 4/2020
(Continued)

OTHER PUBLICATIONS

Supplementary European Search Report in the European application No. 21165590.7, dated Sep. 21, 2021.

*Primary Examiner* — Olisa Anwah
(74) *Attorney, Agent, or Firm* — Arch & Lake LLP

(57) ABSTRACT

An original noisy signal of each of at least two microphones is acquired by acquiring, using the at least two microphones, an audio signal emitted by each sound source. For each frame in time domain, an estimated frequency-domain signal of each sound source is acquired according to the original noisy signal of each of the at least two microphones. A frequency collection containing a plurality of predetermined static frequencies and dynamic frequencies is determined in a predetermined frequency band range. A weighting coefficient of each frequency contained in the frequency collection is determined according to the estimated frequency-domain signal of the each frequency in the frequency collection. A separation matrix of the each frequency is determined according to the weighting coefficient. The audio signal emitted by each of the at least two sound sources is acquired based on the separation matrix and the original noisy signal.

20 Claims, 6 Drawing Sheets

(51) Int. Cl.
*H04R 1/40* (2006.01)
*H04R 3/00* (2006.01)
*G10L 21/0216* (2013.01)

(52) U.S. Cl.
CPC .... *H04R 3/005* (2013.01); *G10L 2021/02165* (2013.01); *H04R 2410/01* (2013.01)

(56) References Cited

U.S. PATENT DOCUMENTS

| | | | |
|---|---|---|---|
| 2021/0185437 | A1 | 6/2021 | Hou |
| 2021/0185438 | A1 | 6/2021 | Hou |

FOREIGN PATENT DOCUMENTS

| | | | |
|---|---|---|---|
| CN | 111128221 | A | 5/2020 |
| CN | 111179960 | A | 5/2020 |

* cited by examiner

METHOD AND DEVICE FOR PROCESSING AUDIO SIGNAL, AND STORAGE MEDIUM

CROSS-REFERENCE TO RELATED APPLICATIONS

This application is based on and claims priority to Chinese Application No. 202010577106.3 filed on Jun. 22, 2020, the disclosure of which is hereby incorporated by reference in its entirety for all purposes.

BACKGROUND

In related art, smart product equipment picks up sound mostly using a microphone array, and microphone beamforming technology is applied to improve quality of voice signal processing, so as to improve a voice recognition rate in a real environment. However, beamforming technology for a plurality of microphones is sensitive to an error in a location of a microphone, and there is a greater impact on performance. In addition, an increase in a number of microphones will also lead to an increase in product cost.

Therefore, an increasing number of smart product equipment are equipped with only two microphones. With two microphones, blind source separation technology, which is completely different from beamforming technology for a plurality of microphones, is often adopted to enhance voice. A problem pressing for a solution is how to improve voice quality of signals separated based on blind source separation technology.

SUMMARY

The present disclosure relates to field of signal processing.

The present disclosure provides a method and device for processing an audio signal, and a storage medium.

According to an aspect of the present disclosure, a method for processing an audio signal is provided, and includes:

acquiring an original noisy signal of each of at least two microphones by acquiring, using the at least two microphones, an audio signal emitted by each of at least two sound sources;

for each frame in time domain, acquiring an estimated frequency-domain signal of each of the at least two sound sources according to the original noisy signal of each of the at least two microphones;

determining a frequency collection containing a plurality of predetermined static frequencies and dynamic frequencies in a predetermined frequency band range, the dynamic frequencies being frequencies whose frequency data meeting a filter condition;

determining a weighting coefficient of each frequency contained in the frequency collection according to the estimated frequency-domain signal of the each frequency in the frequency collection;

determining a separation matrix of the each frequency according to the weighting coefficient; and acquiring, based on the separation matrix and the original noisy signal, the audio signal emitted by each of the at least two sound sources.

According to an aspect of the present disclosure, a device for processing an audio signal is provided. The device includes at least: a processor and a memory for storing executable instructions executable on the processor.

When the processor is used to execute the executable instructions, the executable instructions execute steps in any one aforementioned method for processing an audio signal.

According to an aspect of the present disclosure, a non-transitory computer-readable storage medium is provided. The computer-readable storage medium has stored thereon computer-executable instructions which, when executed by a processor, implement steps in any one aforementioned method for processing an audio signal.

It should be understood that the general description above and the elaboration below are illustrative and explanatory only, and do not limit the present disclosure.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

DETAILED DESCRIPTION

Figure 1:
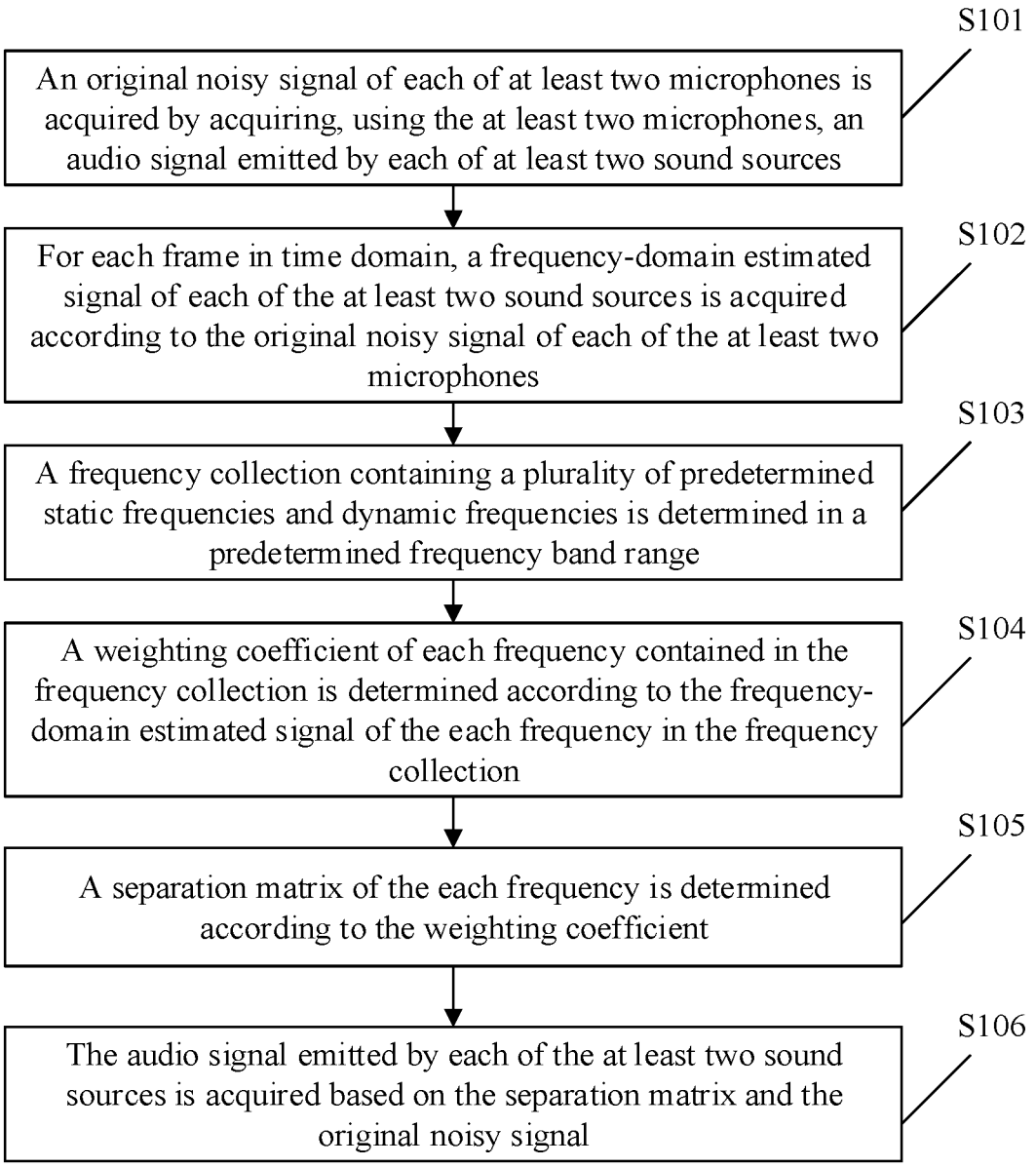
FIG. 1 is a flowchart 1 of a method for processing an audio signal in accordance with an embodiment of the present disclosure.

Reference will now be made in detail to illustrative embodiments, examples of which are illustrated in the accompanying drawings. The following description refers to the accompanying drawings in which the same numbers in different drawings represent the same or similar elements unless otherwise represented. The implementations set forth in the following description of illustrative embodiments do not represent all implementations consistent with the invention. Instead, they are merely examples of devices and methods consistent with aspects related to the invention as recited in the appended claims. The illustrative implementation modes may take on multiple forms, and should not be taken as being limited to examples illustrated herein. Instead, by providing such implementation modes, embodiments herein may become more comprehensive and complete, and comprehensive concept of the illustrative implementation modes may be delivered to those skilled in the art. Implementations set forth in the following illustrative embodiments do not represent all implementations in accordance with the subject disclosure. Rather, they are merely examples of the apparatus and method in accordance with certain aspects herein as recited in the accompanying claims.

Note that although a term such as first, second, third may be adopted in an embodiment herein to describe various kinds of information, such information should not be limited to such a term. Such a term is merely for distinguishing information of the same type. For example, without departing from the scope of the embodiments herein, the first information may also be referred to as the second information. Similarly, the second information may also be referred to as the first information. Depending on the context, a "if" as used herein may be interpreted as "when" or "while" or "in response to determining that".

As used herein, the term "if" or "when" may be understood to mean "upon" or "in response to" depending on the context. These terms, if appear in a claim, may not indicate that the relevant limitations or features are conditional or optional.

The terms "module," "sub-module," "circuit," "sub-circuit," "circuitry," "sub-circuitry," "unit," or "sub-unit" may include memory (shared, dedicated, or group) that stores code or instructions that can be executed by one or more processors. A module may include one or more circuits with or without stored code or instructions. The module or circuit may include one or more components that are directly or indirectly connected. These components may or may not be physically attached to, or located adjacent to, one another.

A unit or module may be implemented purely by software, purely by hardware, or by a combination of hardware and software. In a pure software implementation, for example, the unit or module may include functionally related code blocks or software components, that are directly or indirectly linked together, so as to perform a particular function.

In addition, described characteristics, structures or features may be combined in one or more implementation modes in any proper manner. In the following descriptions, many details are provided to allow a full understanding of embodiments herein. However, those skilled in the art will know that the technical solutions of embodiments herein may be carried out without one or more of the details; alternatively, another method, component, device, option, etc., may be adopted. Under other conditions, no detail of a known structure, method, device, implementation, material or operation may be shown or described to avoid obscuring aspects of embodiments herein.

A block diagram shown in the accompanying drawings may be a functional entity which may not necessarily correspond to a physically or logically independent entity. Such a functional entity may be implemented in form of software, in one or more hardware modules or integrated circuits, or in different networks and/or processor devices and/or microcontroller devices.

A terminal may sometimes be referred to as a smart terminal. The terminal may be a mobile terminal. The terminal may also be referred to as User Equipment (UE), a Mobile Station (MS), etc. A terminal may be equipment or a chip provided therein that provides a user with a voice and/or data connection, such as handheld equipment, onboard equipment, etc., with a wireless connection function. Examples of a terminal may include a mobile phone, a tablet computer, a notebook computer, a palm computer, a Mobile Internet Device (MID), wearable equipment, Virtual Reality (VR) equipment, Augmented Reality (AR) equipment, a wireless terminal in industrial control, a wireless terminal in unmanned drive, a wireless terminal in remote surgery, a wireless terminal in a smart grid, a wireless terminal in transportation safety, a wireless terminal in smart city, a wireless terminal in smart home, etc.

FIG. 1 is a flowchart of a method for processing an audio signal in accordance with an embodiment of the present disclosure. As shown in FIG. 1, the method includes steps as follows.

In S101, an original noisy signal of each of at least two microphones is acquired by acquiring, using the at least two microphones, an audio signal emitted by each of at least two sound sources.

In S102, for each frame in time domain, an estimated frequency-domain signal of each of the at least two sound sources is acquired according to the original noisy signal of each of the at least two microphones.

In S103, a frequency collection containing a plurality of predetermined static frequencies and dynamic frequencies is determined in a predetermined frequency band range. The dynamic frequencies are frequencies whose frequency data meeting a filter condition.

In S104, a weighting coefficient of each frequency contained in the frequency collection is determined according to the estimated frequency-domain signal of the each frequency in the frequency collection.

In S105, a separation matrix of the each frequency is determined according to the weighting coefficient.

In S106, the audio signal emitted by each of the at least two sound sources is acquired based on the separation matrix and the original noisy signal.

The method according to embodiments of the present disclosure is applied in a terminal. Here, the terminal is electronic equipment integrating two or more microphones. For example, the terminal may be an on-board terminal, a computer, or a server, etc.

In an embodiment, the terminal may also be: electronic equipment connected to predetermined equipment that integrates two or more microphones. The electronic equipment receives an audio signal collected by the predetermined equipment based on the connection, and sends a processed audio signal to the predetermined equipment based on the connection. For example, the predetermined equipment is a speaker or the like.

In a practical application, the terminal includes at least two microphones, and the at least two microphones simultaneously detect audio signals emitted respectively by at least two sound sources to acquire the original noisy signal of each of the at least two microphones. Here, it may be understood that in this embodiment, the at least two microphones simultaneously detect audio signals emitted by the two sound sources.

In embodiments of the present disclosure, there are two or more microphones, and there are two or more sound sources.

In embodiments of the present disclosure, the original noisy signal is: a mixed signal including sounds emitted by at least two sound sources. For example, there are two microphones, namely microphone 1 and microphone 2, and there are two sound sources, namely sound source 1 and sound source 2. Then, the original noisy signal of microphone 1 includes audio signals of the sound source 1 and the sound source 2; the original noisy signal of the microphone 2 also includes audio signals of the sound source 1 and the sound source 2.

For example, there are three microphones, i.e., microphone 1, microphone 2, and microphone 3; there are three sound sources, i.e., sound source 1, sound source 2, and sound source 3. Then, the original noisy signal of microphone 1 includes audio signals of sound source 1, sound source 2 and sound source 3. Original noisy signals of the microphone 2 and the microphone 3 also include audio signals of sound source 1, sound source 2 and sound source 3.

It is understandable that if sound emitted by a sound source is an audio signal in a corresponding microphone, the signal of another sound source in the microphone is a noise signal. Embodiments of the present disclosure are to recover sound emitted by at least two sound sources from at least two microphones.

It is understandable that the number of sound sources is generally the same as the number of microphones. If, in some embodiments, the number of microphones is less than the number of sound sources, the number of sound sources may be reduced to a dimension equal to the number of microphones.

It is understandable that when collecting the audio signal of the sound emitted by a sound source, a microphone may collect the audio signal in at least one audio frame. In this case, a collected audio signal is the original noisy signal of each microphone. The original noisy signal may be a time-domain signal or a frequency-domain signal. If the original noisy signal is a time-domain signal, the time-domain signal may be converted into a frequency-domain signal according to a time-frequency conversion operation.

Here, a time-domain signal may be transformed into frequency domain based on Fast Fourier Transform (FFT). Alternatively, a time-domain signal may be transformed into frequency domain based on short-time Fourier transform (STFT). Alternatively, a time-domain signal may be transformed into frequency domain based on another Fourier transform.

Illustratively, if the time-domain signal of the pth microphone in the nth frame is: $x_p''(m)$, the time-domain signal in the nth frame is transformed into a frequency-domain signal, and the original noisy signal in the nth frame is determined to be: $X_p(k,n)=\text{STFT}\ (x_p''(m))$. The m is the number of discrete time points of the time-domain signal in the nth frame. k is a frequency. In this way, in this embodiment, the original noisy signal of each frame may be acquired through the change from time domain to frequency domain. Of course, the original noisy signal of each frame may also be acquired based on another FFT formula, which is not limited here.

An initial estimated frequency-domain signal may be acquired by a priori estimation according to the original noisy signal in frequency domain.

Illustratively, the original noisy signal may be separated according to an initialized separation matrix, such as an identity matrix, or according to the separation matrix acquired in the last frame, acquiring the estimated frequency-domain signal of each sound source in each frame. This provides a basis for subsequent isolation of the audio signal of each sound source based on an estimated frequency-domain signal and a separation matrix.

In embodiments of the present disclosure, predetermined static frequencies and dynamic frequencies are selected from a predetermined frequency band range, to form a frequency collection. Then, subsequent computation is performed only according to each frequency in the frequency collection, instead of directly processing all frequencies in sequence. Here, the predetermined frequency band range may be a common range of an audio signal, or a frequency band range determined according to an audio processing requirement, such as the frequency band range of a human language or the frequency band range of human hearing.

In embodiments of the present disclosure, the selected frequencies include predetermined static frequencies. Static frequencies may be based on a predetermined rule, such as fundamental frequencies at a fixed interval or frequency multiples of a fundamental frequency, etc. The fixed interval may be determined according to harmonic characteristics of the sound wave. Dynamic frequencies are selected according to characteristics of each frequency per se, and frequencies within a frequency band range that meet a predetermined filter condition are added to the frequency collection. For example, a frequency is selected corresponding to sensitivity of the frequency to noise, or the signal strength of audio data of the frequency and separation of each frequency in each frame, etc.

With a technical solution of embodiments of the present disclosure, the frequency collection is determined according to both predetermined static frequencies and dynamic frequencies, and the weighting coefficient is determined according to the estimated frequency-domain signal corresponding to each frequency in the frequency collection. Compared to direct determination of the weighting coefficient according to the estimated frequency-domain signal of each frequency in prior art, not only a law of dependence of an acoustic signal but also a data feature of the signal itself are taken into account, thereby implementing frequency processing according to dependence thereof, thus improving accuracy in signal isolation by frequency, improving recognition performance, reducing post-isolation voice impairment.

In addition, with the method for processing an audio signal according to embodiments of the present disclosure, compared to sound source signal isolation implemented using beamforming technology for a plurality of microphones in prior art, locations of these microphones do not have to be considered, thereby separating, with improved precision, audio signals emitted by sound sources. If the method for processing an audio signal is applied to terminal equipment with two microphones, compared to beamforming technology for 3 or more microphones in prior art to improve voice quality, it also greatly reduces the number of microphones, reducing terminal hardware cost.

In some embodiments, the frequency collection containing the plurality of the predetermined static frequencies and the dynamic frequencies may be determined in the predetermined frequency band range as follows.

A plurality of harmonic subsets may be determined in the predetermined frequency band range. Each of the harmonic subsets may contain a plurality of frequency data. Frequencies contained in the plurality of the harmonic subsets may be the predetermined static frequencies.

A dynamic frequency collection may be determined according to a condition number of an a priori separation matrix of the each frequency in the predetermined frequency band range. The a priori separation matrix may include: a predetermined initial separation matrix or a separation matrix of the each frequency in a last frame.

The frequency collection may be determined according to a union of the harmonic subsets and the dynamic frequency collection.

In embodiments of the present disclosure, for the static frequencies, the predetermined frequency band range is divided into a plurality of harmonic subsets. Here, the predetermined frequency band range may be a common range of an audio signal, or a frequency band range determined according to an audio processing requirement. For example, the entire frequency band is divided into L harmonic subsets according to the frequency range of a fundamental tone. Illustratively, the frequency range of a fundamental tone is 55 Hz to 880 Hz, and L=49. Then, in the lth harmonic subset, the fundamental frequency is: $F_1=F_1\cdot 2^{(l-1)/12F}$. $F_l$=55 Hz.

In embodiments of the present disclosure, each harmonic subset contains a plurality of frequency data. The weighting coefficient of each frequency contained in a harmonic subset may be determined according to the estimated frequency-domain signal at each frequency in the harmonic subset. A separation matrix may be further determined according to the weighting coefficient. Then, the original noisy signal is separated according to the determined separation matrix of the each frequency, acquiring a posterior estimated frequency-domain signal of each sound source. Here, compared to an a priori estimated frequency-domain signal, a posterior estimated frequency-domain signal takes the weighting coefficient of each frequency into account, and therefore is more close to an original signal of each sound source.

Here, $C_l$ represents the collection of frequencies contained in the lth harmonic subset. Illustratively, the collection consists of a fundamental frequency $F_l$ and the first M of the frequency multiples of the fundamental frequency $F_l$. Alternatively, the collection consists of at least part of the frequencies in the bandwidth around a frequency multiple of the fundamental frequency $F_l$.

Since the frequency collection of a harmonic subset reflecting a harmonic structure is determined based on a fundamental frequency and the first M frequencies multiples of the fundamental frequency, there is a stronger dependence among frequencies within a range of the frequency multiples. Therefore, the weighting coefficient is determined according to the estimated frequency-domain signal corresponding to each frequency in each harmonic subset. Compared to determination of a weighting coefficient directly according to each frequency in related art, with the static part of embodiments of the present disclosure, by division into harmonic subsets, each frequency is processed according to its dependence.

In embodiments of the present disclosure, a dynamic frequency collection is also determined according to a condition number of an a priori separation matrix corresponding to data of each frequency. A condition number is determined according to the product of the norm of a matrix and the norm of the inverse matrix, and is used to judge an ill-conditioned degree of the matrix. An ill-conditioned degree is sensitivity of a matrix to an error. The higher the ill-conditioned degree is, the stronger the dependence among frequencies. In addition, since the a priori separation matrix includes the separation matrix of each frequency in the last frame, it reflects data characteristics of each frequency in the current audio signal. Compared to frequencies in the static part of a harmonic subset, it takes data characteristics of an audio signal itself into account, adding frequencies of strong dependence other than the harmonic structure to the frequency collection.

In some embodiments, the plurality of the harmonic subsets may be determined in the predetermined frequency band range as follows.

A fundamental frequency, first M of frequency multiples, and frequencies within a first preset bandwidth where each of the frequency multiples is located may be determined in each frequency band range.

The harmonic subsets may be determined according to a collection consisting of the fundamental frequency, the first M of the frequency multiples, and the frequencies within the first preset bandwidth where the each of the frequency multiples is located.

In embodiments of the present disclosure, frequencies contained in each harmonic subset may be determined according to the fundamental frequency and frequency multiples of the each harmonic subset. First M frequencies in a harmonic subset and frequencies around the each frequency multiple have stronger dependence. Therefore, the frequency collection $C_l$ of a harmonic subset includes the fundamental frequency, the first M frequency multiples, and the frequencies within the preset bandwidth around each frequency multiple.

In some embodiments, the fundamental frequency, the first M of the frequency multiples, and the frequencies within the first preset bandwidth where the each of the frequency multiples is located in the each frequency band range may be determined as follows.

The fundamental frequency of the each of the harmonic subsets and the first M of the frequency multiples corresponding to the fundamental frequency of the each of the harmonic subsets may be determined according to the predetermined frequency band range and a predetermined number of the harmonic subsets into which the predetermined frequency band range is divided.

The frequencies within the first preset bandwidth may be determined according to the fundamental frequency of the each of the harmonic subsets and the first M of the frequency multiples corresponding to the fundamental frequency of the each of the harmonic subsets.

The harmonic subsets, that is, collections of static frequencies may be determined by $$C_l = \left\{ k \in \{1, \ldots, K\} \,\middle|\, \frac{f_k - mF_l}{mF_l} < \delta \text{ for } \exists m \in \{1, \ldots, M\} \right\}.$$

$f_k$ is the kth frequency, in Hz. The expression after the for indicates the value range of the m in the formula.

The bandwidth around the mth frequency $mF_l$ is $2\delta mF_l$. $\delta$ is a parameter controlling the bandwidth, that is, the preset bandwidth. Illustratively, $\delta=0.2$.

In this way, through control of the preset bandwidth, the frequency collection of each of the harmonic subsets is determined, and frequencies on the entire frequency band are grouped according to different dependence based on the harmonic structure, thereby improving accuracy in subsequent processing.

In some embodiments, the dynamic frequency collection may be determined according to the condition number of the a priori separation matrix of the each frequency in the predetermined frequency band range as follows.

The condition number of the a priori separation matrix of the each frequency in the predetermined frequency band range may be determined.

A first-type ill-conditioned frequency with a condition number greater than a predetermined threshold may be determined.

Frequencies in a frequency band centered on the first-type ill-conditioned frequency and having a bandwidth of a second preset bandwidth may be determined as second-type ill-conditioned frequencies.

The dynamic frequency collection may be determined according to the first-type ill-conditioned frequency and the second-type ill-conditioned frequencies.

In embodiments of the present disclosure, for the dynamic part, a condition number condW(k) is computed for each frequency in each frame of an audio signal. condW(k)=cond(W (k)), k=1, . . . ,K. Each frequency k=1, . . . ,K in the entire frequency band may be divided into D sub-bands. It may be determined respectively in each sub-band that a condition number is greater than a predetermined threshold. For example, the frequency $kmax_d$ with the greatest condition number in a sub-band is the first-type ill-conditioned frequency; and frequencies within a bandwidth $\delta d$ on either side of the frequency are taken. δd may be determined as needed. Illustratively, δd=20 Hz.

Frequencies selected in each sub-band include: $O_d=\{k\in\{1, \ldots, K\} | \text{abs}(k-k\max_d)<\delta d\}$, d=1, 2, . . . , D. Then, the dynamic frequency collection is a collection of dynamic frequencies on each sub-band: $O=\{O_1, \ldots, O_D\}$. The abs represents an operation to take the absolute value.

In embodiments of the present disclosure, the collection of dynamic frequencies may be added to each of the harmonic subsets, respectively. Thus, dynamic frequencies are added to each harmonic subset, that is, $CO_l=\{C_l, O\}$, l=1, . . . ,L.

In this way, an ill-conditioned frequency is selected according to the predetermined harmonic structure and a data feature of a frequency, so that frequencies of strong dependence may be processed, improving processing efficiency, which is also more in line with a structural feature of an audio signal, and thus has more powerful separation performance.

Figure 2:
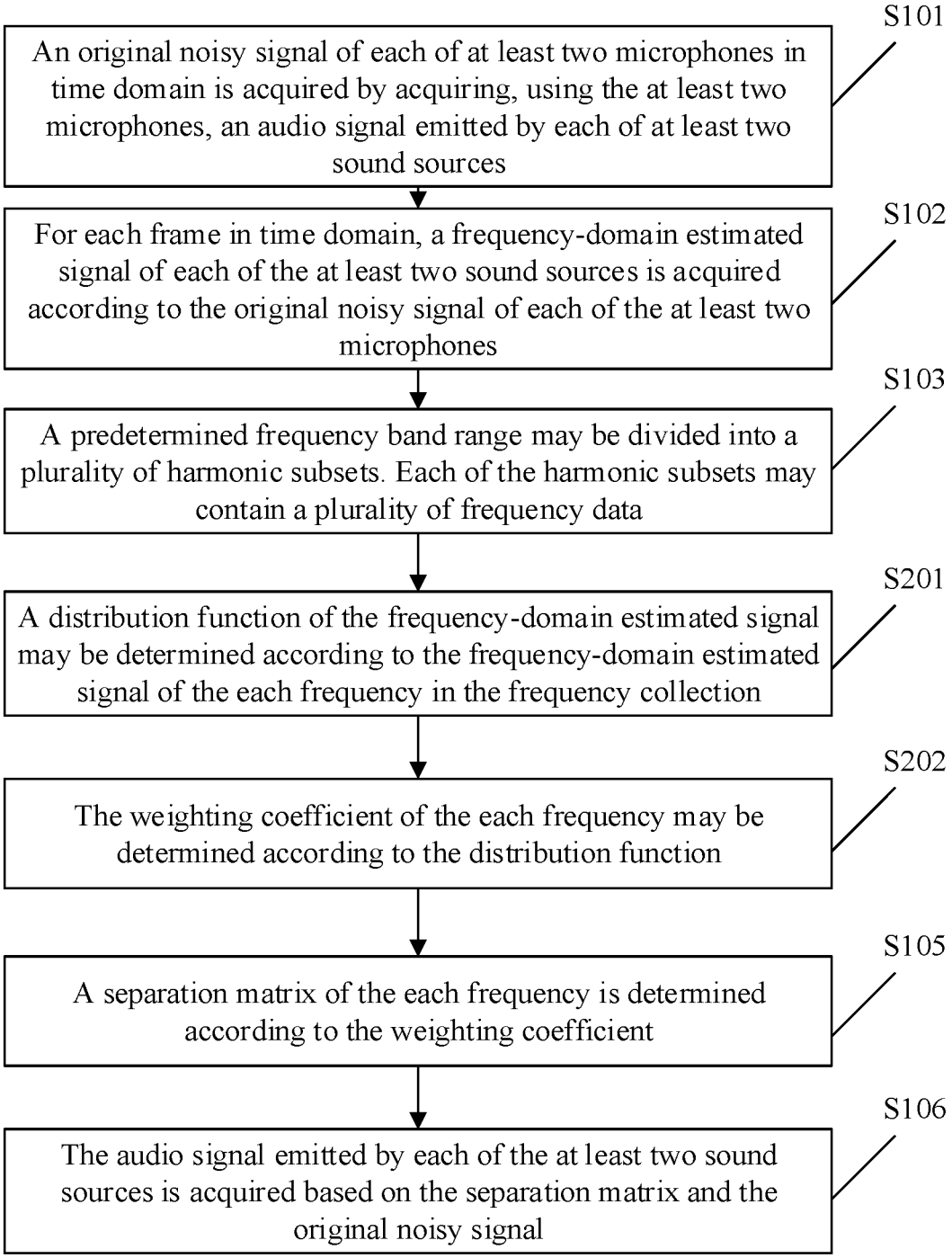
FIG. 2 is a flowchart 2 of a method for processing an audio signal in accordance with an embodiment of the present disclosure.

In some embodiments, as shown in FIG. 2, in S104, the weighting coefficient of the each frequency contained in the frequency collection may be determined according to the estimated frequency-domain signal of the each frequency in the frequency collection as follows.

In S201, a distribution function of the estimated frequency-domain signal may be determined according to the estimated frequency-domain signal of the each frequency in the frequency collection.

In S202, the weighting coefficient of the each frequency may be determined according to the distribution function.

In embodiments of the present disclosure, a frequency corresponding to each frequency-domain estimation component may be continuously updated based on the weighting coefficient of each frequency in the frequency collection and the estimated frequency-domain signal of each frame, so that the updated separation matrix of each frequency in frequency-domain estimation components may have improved separation performance, thereby further improving accuracy of an isolated audio signal.

Here, a distribution function of the estimated frequency-domain signal may be constructed according to the estimated frequency-domain signal of the each frequency in the frequency collection. The frequency collection includes each fundamental frequency and a first number of frequency multiples of the each fundamental frequency, forming a harmonic subset with strong inter-frequency dependence, as well as strongly dependent dynamic frequencies determined according to a condition number. Therefore, a distribution function may be constructed based on frequencies of strong dependence in an audio signal.

Illustratively, the separation matrix may be determined based on eigenvalues acquired by solving a covariance matrix. The covariance matrix $V_p(k,n)$ satisfies a relationship of $V_p(k,n)=\beta V_p(k,n-1)+(1-\beta)\varphi_p(k,n)\, X_p(k,n)\, X_p^H(k,n)$. β is a smoothing coefficient, $V_p(k,n-1)$ is the updated covariance updated of last frame, $X_p(k,n)$ is the original noisy signal of the current frame, and $X_p^H(k,n)$ is the conjugate transposed matrix of the original noisy signal of the current frame.

$$\varphi_p(k, n) = \frac{G'(Y_p(n))}{r_p(n)}$$

is the weighting factor.

$$r_p(n) = \sqrt{\sum_{k=1}^{K} |Y_p(k, n)|^2}$$

is an auxiliary variable. $G(\overline{Y}_p(n))=-\log p(\overline{Y}_p(n))$ is referred to as a contrast function. Here, $p(\overline{Y}_p(n))$ represents a multi-dimensional super-Gaussian a priori probability density distribution model of the pth sound source based on the entire frequency band, that is, the distribution function. $\overline{Y}_p(n)$ is the matrix vector, which represents the estimated frequency-domain signal of the pth sound source in the nth frame, $Y_p(n)$ is the estimated frequency-domain signal of the pth sound source in the nth frame, and $Y_p(k,n)$ represents the estimated frequency-domain signal of the pth sound source in the nth frame at the kth frequency. The log represents a logarithm operation.

In embodiments of the present disclosure, using the distribution function, construction may be performed based on the weighting coefficient determined based on the estimated frequency-domain signal in the frequency collection selected. Compared to consideration of the a priori probability density of all frequencies in the entire frequency band in related art, for the weighting coefficient determined as such, only the a priori probability density of selected frequencies of strong dependence has to be considered. In this way, on one hand, computation may be simplified, and on the other hand, there is no need to consider frequencies in the entire frequency band that are far apart from each other or have weak dependence, improving separation performance of the separation matrix while effectively improving processing efficiency, facilitating subsequent isolation of a high-quality audio signal based on the separation matrix.

In some embodiments, the distribution function of the estimated frequency-domain signal may be determined according to the estimated frequency-domain signal of the each frequency in the frequency collection as follows.

A square of a ratio of the estimated frequency-domain signal of the each frequency in the frequency collection to a standard deviation may be determined.

A first sum may be determined by summing over the square of the ratio of the frequency collection in each frequency band range.

A second sum may be acquired as a sum of a root of the first sum corresponding to the frequency collection.

The distribution function may be determined according to an exponential function that takes the second sum as a variable.

In embodiments of the present disclosure, a distribution function may be constructed according to the estimated frequency-domain signal of a frequency in the frequency collection. For the static part, the entire frequency band may be divided into L harmonic subsets. Each of the harmonic subsets contains a number of frequencies. $C_l$ denotes the collection of frequencies contained in the lth harmonic subset.

For the dynamic part, $O_d$ denotes the collection of dynamic frequencies of the dth sub-band, and the dynamic frequency collection is expressed as: $O=\{O_1, \ldots, O_D\}$.

In embodiments of the present disclosure, the frequency collection includes the collection of static frequencies in the harmonic subsets and the dynamic frequency collection, and is expressed as: $CO_l=\{C_l, O\}$, l=1, . . . ,L.

Based on this, the distribution function may be defined according to the following formula (1):

$$p(\overline{Y}_p(n)) = \alpha\exp\left(-\sum_{l=1}^{L}\sqrt{\sum_{k\in CO_l}\frac{|Y_p(k,n)|^2}{\sigma_{plk}^2}}\right) = \alpha\exp\left(-\sum_{l=1}^{L}\left(\sum_{k\in CO_l}\frac{|Y_p(k,n)|^2}{\sigma_{plk}^2}\right)^{\frac{1}{2}}\right) \quad (1)$$

In the formula (1), k is a frequency, $\sigma_{plk}^2$ is the variance, l is a harmonic subset, $\alpha$ is a coefficient, and $Y_p(k,n)$ represents the estimated frequency-domain signal of the pth sound source in the nth frame at the kth frequency. Based on the formula (1), a square of a ratio of the estimated frequency-domain signal of each frequency in each harmonic subset to a standard deviation may be determined. That is, the square of the ratio of the estimated frequency-domain signal for each frequency $k\in CO_1$ to the standard deviation is acquired, and then, a sum over the square corresponding to each frequency in the harmonic subsets, that is, the first sum, is acquired. The second sum is acquired by summing over a square root of the first sum corresponding to each collection of frequencies, i.e., summing over a square root of each first sum with l from 1 to L. Then, the distribution function is acquired base an exponential function of the second sum. The exp presents an operation of an exponential function based on the natural constant e.

In embodiments of the present disclosure, with the formula, computation is performed based on frequencies contained in each harmonic subset, and then on each harmonic subset. Therefore, compared to processing in prior art that assumes all frequencies have the same dependence and computation is performed directly for all frequencies on the entire frequency band, such as $$p(\overline{Y}_p(n)) = \exp\left(-\sqrt{\sum_{k=1}^{K}|Y_p(k,n)|^2}\right) = \exp(-r_p(n)),$$

the solution here is based on strong dependence among frequencies within a harmonic structure, as well as on strongly dependent frequencies beyond the harmonic structure in an audio signal. Dependent frequencies, reducing processing of weakly dependent frequencies. Such a way is more in line with a signal feature of an actual audio signal, improving accuracy in signal isolation.

In some embodiments, the distribution function of the estimated frequency-domain signal may be determined according to the estimated frequency-domain signal of the each frequency in the frequency collection as follows.

A square of a ratio of the estimated frequency-domain signal of the each frequency in the frequency collection to a standard deviation may be determined.

A third sum may be determined by summing over the square of the ratio of the frequency collection in each frequency band range.

A fourth sum may be determined according to the third sum corresponding to the frequency collection to a predetermined power.

The distribution function may be determined according to an exponential function that takes the fourth sum as a variable.

In embodiments of the present disclosure, similar to the last embodiment, a distribution function may be constructed according to the estimated frequency-domain signal of a frequency in the frequency collection. For the static part, the entire frequency band may be divided into L harmonic subsets. Each of the harmonic subsets contains a number of frequencies. $C_l$ denotes the collection of frequencies contained in the lth harmonic subset.

For the dynamic part, $O_d$ denotes the collection of dynamic frequencies of the dth sub-band, and the dynamic frequency collection is expressed as: $O=\{O_1, \ldots, O_D\}$.

In embodiments of the present disclosure, the frequency collection includes the collection of static frequencies in the harmonic subsets and the dynamic frequency collection, and is expressed as: $CO_l=\{C_l,O\}$, $l=1, \ldots ,L$.

Based on this, the distribution function may also be defined according to the following formula (2):

$$p(\overline{Y}_p(n)) = \alpha\exp\left(-\sum_{l=1}^{L}\frac{2}{3}\left(\sum_{k\in CO_l}\frac{|Y_p(k,n)|^2}{\sigma_{plk}^2}\right)^{\frac{2}{3}}\right) \quad (2)$$

In the formula (2), k is a frequency, $Y_p(k,n)$ is the estimated frequency-domain signal for the frequency k of the pth sound source in the nth frame, $\sigma_{plk}^2$ is the variance, l is a harmonic subset, $\alpha$ is a coefficient. Based on the formula (2), a square of a ratio of the estimated frequency-domain signal, of each frequency in each harmonic subset and the dynamic frequency collection, to a standard deviation, may be determined, and then, a sum over the square corresponding to each frequency in the harmonic subsets, that is, the third sum, is acquired. The fourth sum is acquired by summing over the third sum corresponding to each collection of frequencies to a predetermined power (⅔ in the formula (2), for example). Then, the distribution function is acquired base an exponential function of the fourth sum.

The formula (2) is similar to the formula (1) in that both formulae perform computation based on frequencies contained in the harmonic subsets as well as frequencies in the dynamic frequency collection. The second formula has the technical effect same as that of the formula (1) in the last embodiment compared to prior art, which is not repeated here.

Embodiments of the present disclosure also provide an example as follows.

Figure 3:
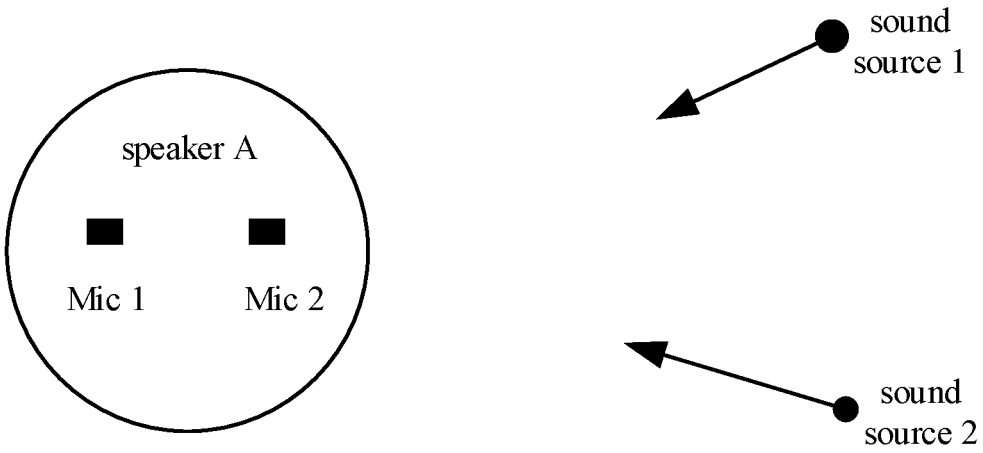
FIG. 3 is a block diagram of a scene of application of a method for processing an audio signal in accordance with an embodiment of the present disclosure.
Figure 4:
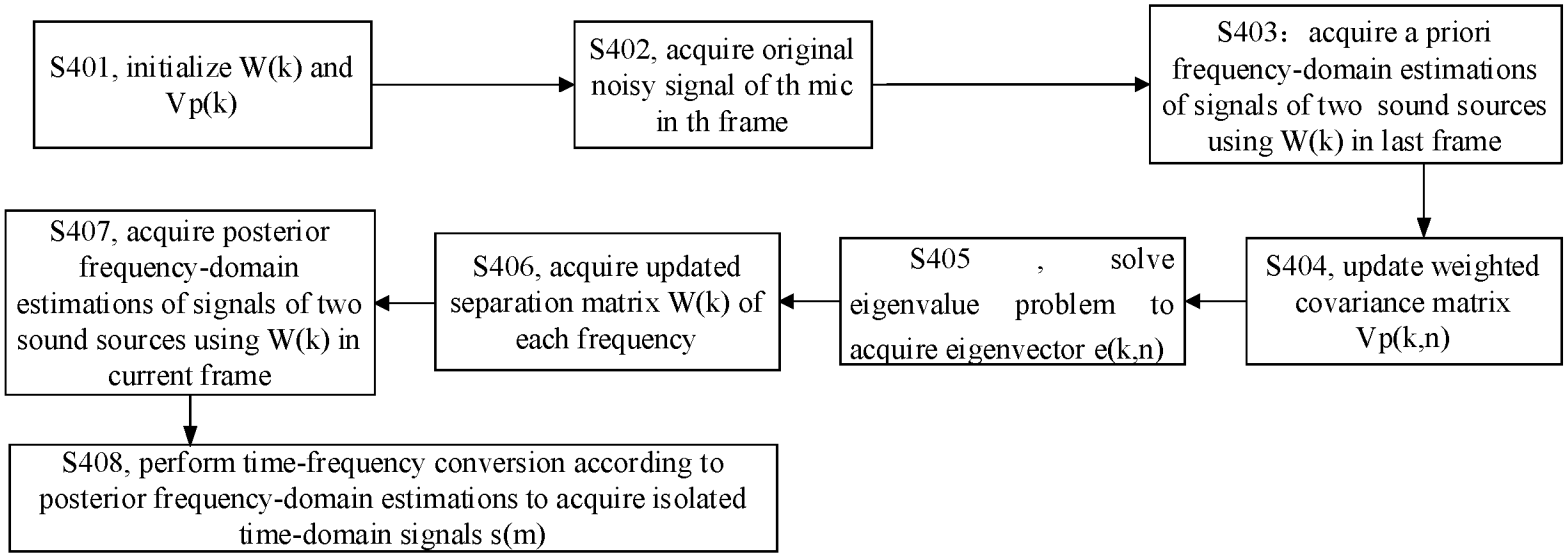
FIG. 4 is a flowchart 3 of a method for processing an audio signal in accordance with an embodiment of the present disclosure.

FIG. 4 is a flowchart of a method for processing an audio signal in accordance with an embodiment of the present disclosure. In the method for processing an audio signal, as shown in FIG. 3, sound sources include a sound source 1 and a sound source 2. Microphones include microphone 1 and microphone 2. Audio signals of the sound source 1 and the sound source 2 are recovered from the original noisy signals of the microphone 1 and the microphone 2 based on the method for processing an audio signal. As shown in FIG. 4, the method includes steps as follows.

In S401, W(k) and $V_p(k)$ may be initialized.

The initialization includes steps as follows. Assuming a system frame length of Nfft, the frequency K=Nfft/2+1.

1) The separation matrix of each frequency may be initialized.

$$W(k) = [w_1(k), w_2(k)]^H = \begin{bmatrix}1 & 0\\0 & 1\end{bmatrix}\cdot\begin{bmatrix}1 & 0\\0 & 1\end{bmatrix}$$

is the identity matrix. k is a frequency. The k=1,L,K.

2) The weighted covariance matrix $V_p(k)$ of each sound source at each frequency may be initialized.

$$V_p(k) = \begin{bmatrix} 0 & 0 \\ 0 & 0 \end{bmatrix} \cdot \begin{bmatrix} 0 & 0 \\ 0 & 0 \end{bmatrix}$$

is a zero matrix. The p is used to represent a microphone. p=1,2.

In S402, the original noisy signal of the pth microphone in the nth frame may be acquired.

Windowing may be performed on $x_p^n(m)$ for Nfft points, acquiring the corresponding frequency-domain signal: $x_p(k, n)=\mathrm{STFT}(x_p^n(m))$. The m is the number of points selected for Fourier transform. The STFT is short-time Fourier transform. The $x_p^n(m)$ is a time-domain signal of the pth microphone in the nth frame. Here, the time-domain signal is an original noisy signal.

Then, an observed signal of the $X_p(k,n)$ is: $X(k,n)=[X_1(k,n), X_2(k,n)]^T$. $[X_1(k,n), X_2(k,n)]^T$ is a transposed matrix.

In S403, a priori frequency-domain estimations of signals of two sound sources may be acquired using W(k) in the last frame.

A priori frequency-domain estimations of the signals of the two sound sources are $Y(k,n)=[Y_1(k,n), Y_2(k,n)]^T$. $Y_1(k,n)$, $Y_2(k,n)$ are estimated values of sound source 1 and sound source 2 at the time-frequency point (k,n), respectively.

An observation matrix may be separated through the separation matrix W(k) to acquire: $Y(k,n)=W(k)'X(k,n)$. W'(k) is the separation matrix of the last frame (i.e., the previous frame of the current frame).

Then the a priori frequency-domain estimation of the pth sound source in the nth frame is: $\overline{Y}_p(n)=[Y_p(1, n),L\ Y_p(K, n)]^T$.

In S404, the weighted covariance matrix $V_p(k,n)$ may be updated.

The updated weighted covariance matrix may be computed: $V_p(k,n)=\beta V_p(k,n-1)+(1-\beta)\varphi_p(k,n)\, X_p(k,n)\, X_p^H(k,n)$. The β is a smoothing coefficient. In an embodiment, the β is 0.98. The $V_p(k,n-1)$ is the weighted covariance matrix of the last frame. The $X_p^H(k,n)$ is the conjugate transpose of the $X_p(k,n)$. The $$\varphi_p(n) = \frac{G'(\overline{Y}_p(n))}{r_p(n)}$$

is a weighting coefficient. The $$r_p(n) = \sqrt{\sum_{k=1}^{K} |Y_p(k, n)|^2}$$

is an auxiliary variable. The $G(\overline{Y}_p(n))=-\log p(\overline{Y}_p(n))$ is a contrast function.

The $p(\overline{Y}_p(n))$ represents a multi-dimensional super-Gaussian a priori probability density function of the pth sound source based on the entire frequency band. In an embodiment, $$p(\overline{Y}_p(n)) = \exp\left(-\sqrt{\sum_{k=1}^{K} |Y_p(k, n)|^2}\right).$$

In this case, if the $$G(\overline{Y}_p(n)) = -\log p(\overline{Y}_p(n)) = \sqrt{\sum_{k=1}^{K} |Y_p(k, n)|^2} = r_p(n),$$

then, the $$\varphi_p(n) = \frac{1}{\sqrt{\sum_{k=1}^{K} |Y_p(k, n)|^2}}.$$

However, this probability density distribution assumes that dependence among all frequencies is the same. In fact, dependence among frequencies far apart is weak, and dependence among frequencies close to each other is strong. Therefore, in embodiments of the present disclosure, $p(\overline{Y}_p(n))$ is constructed based on the harmonic structure of voice and selected dynamic frequencies, thereby performing processing based on strongly dependent frequencies.

Specifically, for the static part, the entire frequency band is divided into L (Illustratively, L=49) harmonic subsets according to the frequency range of a fundamental tone. The fundamental frequency in the lth harmonic subset is: $F_l=F_1\cdot 2^{(l-1)/12}$. $F_1$=55 Hz. $F_1$ ranges from 55 Hz to 880 Hz, covering the entire frequency range of a fundamental tone of human voice.

$C_l$ represents the collection of frequencies contained in the hth harmonic subset. It consists of the first M (M=8, specifically) frequency multiples of the fundamental frequency $F_l$ and frequencies within a bandwidth around a frequency multiple:

$$C_l = \left\{ k \in \{1, \ldots, K\} \,\middle|\, \frac{f_k - mF_l}{mF_l} < \delta \text{ for } \exists\, m \in \{1, \ldots, M\} \right\}.$$

Here, M may be an integer greater or equal than 4. For example, M may be 4, 5, 6, 7, 8, 9, 10, 12, 16, 20. Preferably, M may be less than 12. More preferably, M may be 8 or 10.

$f_k$ is the frequency represented by the kth frequency, in Hz.

The bandwidth around the mth frequency $mF_l$ is $2\delta mF_l$.

δ is a parameter controlling the bandwidth, that is, the preset bandwidth. Illustratively, δ=0.2.

For the dynamic part, a condition number condW(k) is computed for each frequency W(k) in each frame.

condW(k)=cond(W(k)), k=1, . . . ,K. The entire frequency band k=1, . . . ,K may be divided into D sub-bands evenly. The frequency with the greatest condition number in each sub-band is found, and denoted by $kmax_d$.

Frequencies within a bandwidth δd on either side of the frequency are taken. δd may be determined as needed. Illustratively, δd=20 Hz.

Frequencies selected in each sub-band may be expressed as $O_d=\{k\in\{1, \ldots, K\} | (\mathrm{abs}(k-kmax_d)<\delta d\}$, d=1, 2, . . . , D. The collection of frequencies in all $O_d$ is: $O=\{O_1, \ldots, O_D\}$.

Here, O is a collection of ill-conditioned frequencies selected according to a condition of separating each frequency in each frame in real time.

All ill-conditioned frequencies are added respectively into each $C_l$: $CO_l=\{C_l,O\}$, l=1, . . . ,L.

Finally, there are two definitions of a distribution model as determined according to $CO_l$, as follows:

$$p(\overline{Y}_p(n)) = \alpha\exp\left(-\sum_{l=1}^{L}\sqrt{\sum_{k\in CO_l}\frac{|Y_p(k,n)|^2}{\sigma_{plk}^2}}\right) = \exp\left(-\sum_{l=1}^{L}\left(\sum_{k\in CO_l}\frac{|Y_p(k,n)|^2}{\sigma_{plk}^2}\right)^{\frac{1}{2}}\right) \tag{1}$$

$$p(\overline{Y}_p(n)) = \alpha\exp\left(-\sum_{l=1}^{L}\frac{2}{3}\left(\sum_{k\in CO_l}\frac{|Y_p(k,n)|^2}{\sigma_{plk}^2}\right)^{\frac{2}{3}}\right) \tag{2}$$

α represents a coefficient. $\sigma_{plk}^2$ represents the variance. Illustratively, α=1, $\sigma_{phk}^2=1$.

Based on the distribution function in embodiments of the present disclosure, that is, the distribution model, the weighting coefficient may be acquired as:

$$\varphi_p(n) = \sum_{l=1}^{L}\left(\sum_{k\in CO_l}\frac{|Y_p(k,n)|^2}{\sigma_{plk}^2}\right)^{-\frac{1}{2}} \tag{1a}$$

$$\varphi_p(n) = \sum_{l=1}^{L}\left(\frac{2}{3}\sum_{k\in CO_l}\frac{|Y_p(k,n)|^2}{\sigma_{plk}^2}\right)^{-\frac{2}{3}} \tag{2a}$$

In S405, an eigenvector $e_p(k,n)$ may be acquired by solving an eigenvalue problem;

Here, the $e_p(k,n)$ is the eigenvector corresponding to the pth microphone.

The eigenvalue problem: $V_2(k,n)e_p(k,n)=\lambda_p(k,n)V_1(k,n)e_p(k,n)$, is solved, acquiring $$\lambda_1(k,n) = \frac{tr(H(k,n)) + \sqrt{tr(H(k,n))^2 - 4\det(H(k,n))}}{2}$$

$$e_1(k,n) = \begin{pmatrix} H_{22}(k,n) - \lambda_1(k,n) \\ -H_{21}(k,n) \end{pmatrix}$$

$$A_2(k,n) = \frac{tr(H(k,n)) - \sqrt{tr(H(k,n))^2 - 4\det(H(k,n))}}{2}$$

$$e_2(k,n) = \begin{pmatrix} -H_{12}(k,n) \\ H_{11}(k,n) - \lambda_2(k,n) \end{pmatrix}$$

The $H(k,n)=V_1^{-1}(k,n)V_2(k,n)$.

In S406, the updated separation matrix W(k) for each frequency may be acquired.

The updated separation matrix of the current frame $$w_p(k) = \frac{e_p(k,n)}{e_p^H(k,n)V_P(k,n)e_p(k,n)}$$

may be acquired based on the eigenvector of the eigenvalue problem.

In S407, posterior frequency-domain estimations of the signals of the two sound sources may be acquired using W(k) in the current frame.

An original noisy signal is separated using W(k) in the current frame, acquiring posterior frequency-domain estimations $Y(k,n)=[Y_1(k,n),Y_2(k,n)]^T=W(k)X(k,n)$ of the signals of the two sound sources.

In S408, isolated time-domain signals may be acquired by performing time-frequency conversion according to the posterior frequency-domain estimations.

Inverse STFT (ISTFT) and overlap-add may be performed separately on $\overline{Y}_p(n)=[Y_p(1,n), \ldots Y_p(K,n)]^T$ k=1, . . . ,K, acquiring the isolated time-domain sound source signals $s_p^n(m)$, i.e., $x_p^n(m)=\text{ISTFT}(\overline{Y}_p(n))$. m=1, . . . , Nfft. p=1, 2.

With the method according to embodiments of the present disclosure, separation performance may be improved, reducing voice impairment after separation, improving recognition performance, while achieving comparable interference suppression performance using fewer microphones, reducing the cost of a smart product.

Figure 5:
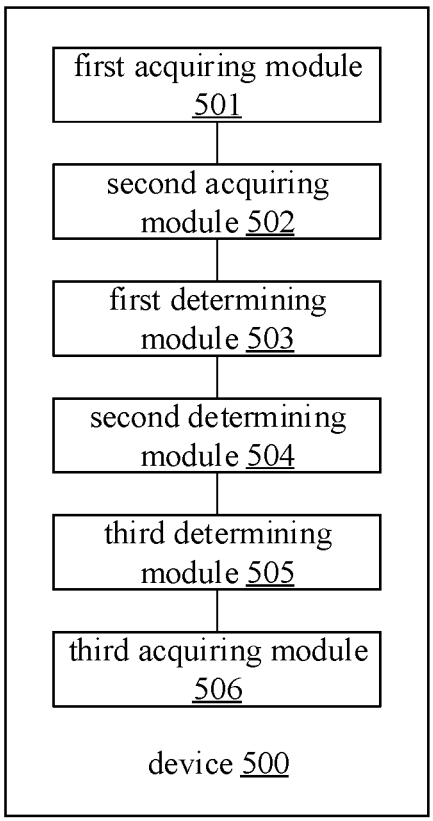
FIG. 5 is a diagram of a structure of a device for processing an audio signal in accordance with an embodiment of the present disclosure.

FIG. 5 is a diagram of a device for processing an audio signal in accordance with an embodiment of the present disclosure. Referring to FIG. 5, the device 500 includes a first acquiring module 501, a second acquiring module 502, a first determining module 503, a second determining module 504, a third determining module 505, and a third acquiring module 506.

The first acquiring module 501 is configured to acquire an original noisy signal of each of at least two microphones by acquiring, using the at least two microphones, an audio signal emitted by each of at least two sound sources.

The second acquiring module 502 is configured, for each frame in time domain, acquiring an estimated frequency-domain signal of each of the at least two sound sources according to the original noisy signal of each of the at least two microphones.

The first determining module 503 is configured to determine a frequency collection containing a plurality of predetermined static frequencies and dynamic frequencies in a predetermined frequency band range. The dynamic frequencies are frequencies whose frequency data meeting a filter condition.

The second determining module 504 is configured to determine a weighting coefficient of each frequency contained in the frequency collection according to the estimated frequency-domain signal of the each frequency in the frequency collection.

The third determining module 505 is configured to determine a separation matrix of the each frequency according to the weighting coefficient.

The third acquiring module 506 is configured to acquire, based on the separation matrix and the original noisy signal, the audio signal emitted by each of the at least two sound sources.

In some embodiments, the first determining module includes:

a first determining sub-module configured to determine a plurality of harmonic subsets in the predetermined frequency band range, each of the harmonic subsets containing a plurality of frequency data, frequencies contained in the plurality of the harmonic subsets being the predetermined static frequencies;

a second determining sub-module configured to determine a dynamic frequency collection according to a condition number of an a priori separation matrix of the each frequency in the predetermined frequency band range, the a priori separation matrix including: a predetermined initial separation matrix or a separation matrix of the each frequency in a last frame; and a third determining sub-module configured to determine the frequency collection according to a union of the harmonic subsets and the dynamic frequency collection.

In some embodiments, the first determining sub-module includes:

a first determining unit configured to determine, in each frequency band range, a fundamental frequency, first M of frequency multiples, and frequencies within a first preset bandwidth where each of the frequency multiples is located; and a second determining unit configured to determine the harmonic subsets according to a collection consisting of the fundamental frequency, the first M of the frequency multiples, and the frequencies within the first preset bandwidth where the each of the frequency multiples is located.

In some embodiments, the first determining unit is specifically configured to:

determine the fundamental frequency of the each of the harmonic subsets and the first M of the frequency multiples corresponding to the fundamental frequency of the each of the harmonic subsets according to the predetermined frequency band range and a predetermined number of the harmonic subsets into which the predetermined frequency band range is divided; and determine the frequencies within the first preset bandwidth according to the fundamental frequency of the each of the harmonic subsets and the first M of the frequency multiples corresponding to the fundamental frequency of the each of the harmonic subsets.

In some embodiments, the second determining sub-module includes:

a third determining unit configured to determine the condition number of the a priori separation matrix of the each frequency in the predetermined frequency band range;

a fourth determining unit configured to determine a first-type ill-conditioned frequency with a condition number greater than a predetermined threshold;

a fifth determining unit configured to determine, as second-type ill-conditioned frequencies, frequencies in a frequency band centered on the first-type ill-conditioned frequency and having a bandwidth of a second preset bandwidth; and a sixth determining unit configured to determine the dynamic frequency collection according to the first-type ill-conditioned frequency and the second-type ill-conditioned frequencies In some embodiments, the second determining module includes:

a fourth determining sub-module configured to determine, according to the estimated frequency-domain signal of the each frequency in the frequency collection, a distribution function of the estimated frequency-domain signal; and a fifth determining sub-module configured to determine, according to the distribution function, the weighting coefficient of the each frequency.

In some embodiments, the fourth determining sub-module is specifically configured to:

determine a square of a ratio of the estimated frequency-domain signal of the each frequency in the frequency collection to a standard deviation;

determine a first sum by summing over the square of the ratio of the frequency collection in each frequency band range;

acquire a second sum as a sum of a root of the first sum corresponding to the frequency collection; and determine the distribution function according to an exponential function that takes the second sum as a variable.

In some embodiments, the fourth determining sub-module is specifically configured to:

determine a square of a ratio of the estimated frequency-domain signal of the each frequency in the frequency collection to a standard deviation;

determine a third sum by summing over the square of the ratio of the frequency collection in each frequency band range;

determine a fourth sum according to the third sum corresponding to the frequency collection to a predetermined power;

determine the distribution function according to an exponential function that takes the fourth sum as a variable.

A module of the device according to an aforementioned embodiment herein may perform an operation in a mode elaborated in an aforementioned embodiment of the method herein, which will not be repeated here.

Figure 6:
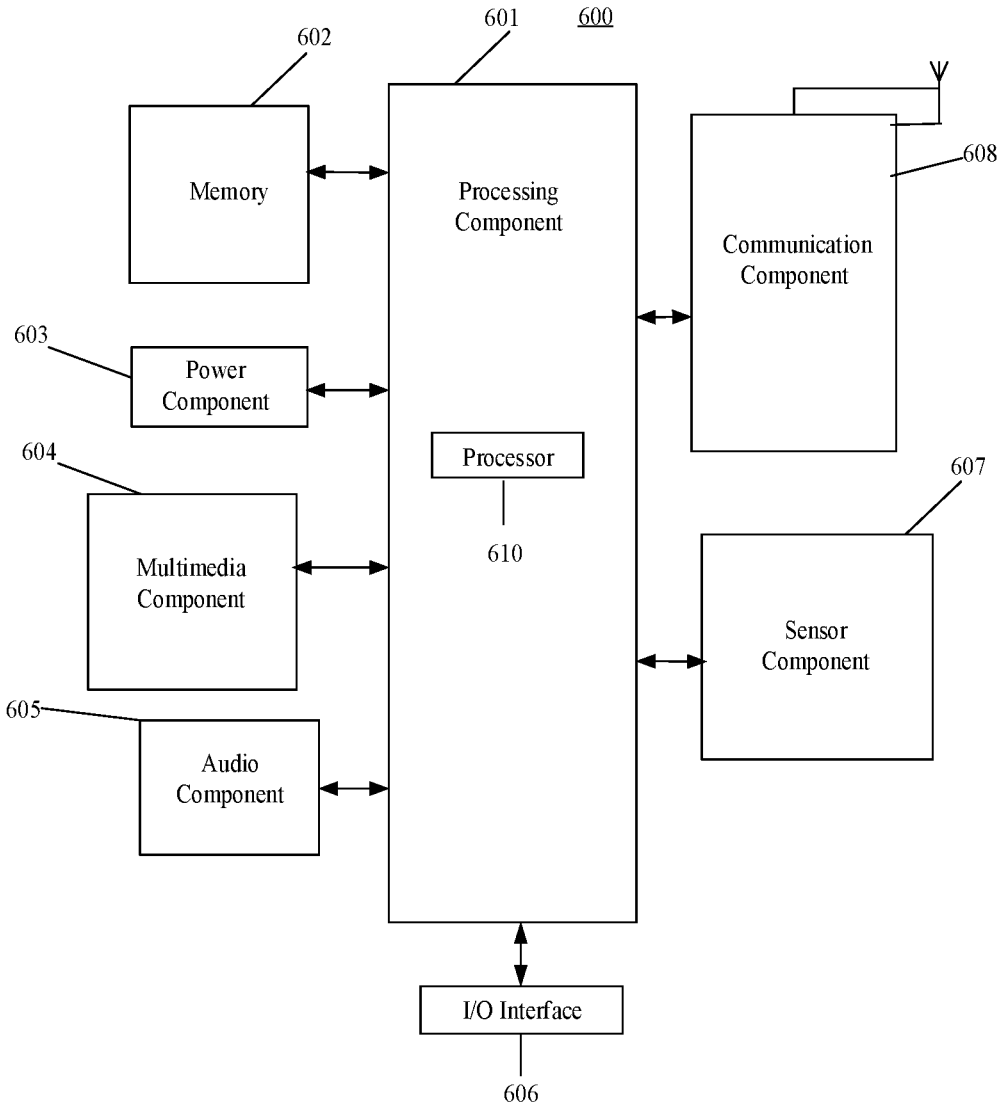
FIG. 6 is a diagram of a physical structure of a device for processing an audio signal in accordance with an embodiment of the present disclosure.

FIG. 6 is a diagram of a physical structure of a device 600 for processing an audio signal in accordance with an embodiment of the present disclosure. For example, the device 600 may be a mobile phone, a computer, a digital broadcasting terminal, a message transceiver, a game console, tablet equipment, medical equipment, fitness equipment, a Personal Digital Assistant (PDA), etc.

Referring to FIG. 6, the device 600 may include one or more components as follows: a processing component 601, a memory 602, a power component 603, a multimedia component 604, an audio component 605, an Input/Output (I/O) interface 606, a sensor component 607, and a communication component 608.

The processing component 601 generally controls an overall operation of the display equipment, such as operations associated with display, a telephone call, data communication, a camera operation, a recording operation, etc. The processing component 601 may include one or more processors 610 to execute instructions so as to complete all or some steps of the method. In addition, the processing component 601 may include one or more modules to facilitate interaction between the processing component 601 and other components. For example, the processing component 601 may include a multimedia module to facilitate interaction between the multimedia component 604 and the processing component 601.

The memory 602 is configured to store various types of data to support operation on the device 600. Examples of these data include instructions of any application or method configured to operate on the device 600, contact data, phonebook data, messages, pictures, videos, and/or the like. The memory 602 may be realized by any type of volatile or non-volatile storage equipment or combination thereof, such as Static Random Access Memory (SRAM), Electrically Erasable Programmable Read-Only Memory (EEPROM), Erasable Programmable Read-Only Memory (EPROM), Programmable Read-Only Memory (PROM), Read-Only Memory (ROM), magnetic memory, flash memory, magnetic disk, or compact disk.

The power component 603 supplies electric power to various components of the device 600. The power component 603 may include a power management system, one or more power supplies, and other components related to generating, managing and distributing electric power for the device 600.

The multimedia component 604 includes a screen providing an output interface between the device 600 and a user. The screen may include a Liquid Crystal Display (LCD) and a Touch Panel (TP). If the screen includes a TP, the screen may be realized as a touch screen to receive an input signal from a user. The TP includes one or more touch sensors for sensing touch, slide and gestures on the TP. The touch sensors not only may sense the boundary of a touch or slide move, but also detect the duration and pressure related to the touch or slide move. In some embodiments, the multimedia component 604 includes a front camera and/or a rear camera. When the device 600 is in an operation mode such as a shooting mode or a video mode, the front camera and/or the rear camera may receive external multimedia data. Each of the front camera and/or the rear camera may be a fixed optical lens system or may have a focal length and be capable of optical zooming.

The audio component 605 is configured to output and/or input an audio signal. For example, the audio component 605 includes a microphone (MIC). When the device 600 is in an operation mode such as a call mode, a recording mode, and a voice recognition mode, the MIC is configured to receive an external audio signal. The received audio signal may be further stored in the memory 602 or may be sent via the communication component 608. In some embodiments, the audio component 605 further includes a loudspeaker configured to output the audio signal.

The I/O interface 606 provides an interface between the processing component 601 and a peripheral interface module. The peripheral interface module may be a keypad, a click wheel, a button or the like. These buttons may include but are not limited to: a homepage button, a volume button, a start button, and a lock button.

The sensor component 607 includes one or more sensors for assessing various states of the device 600. For example, the sensor component 607 may detect an on/off state of the device 600 and relative positioning of components such as the display and the keypad of the device 600. The sensor component 607 may further detect a change in the location of the device 600 or of a component of the device 600, whether there is contact between the device 600 and a user, the orientation or acceleration/deceleration of the device 600, and a change in the temperature of the device 600. The sensor component 607 may include a proximity sensor configured to detect existence of a nearby object without physical contact. The sensor component 607 may further include an optical sensor such as a Complementary Metal-Oxide-Semiconductor (CMOS) or Charge-Coupled-Device (CCD) image sensor used in an imaging application. In some embodiments, the sensor component 607 may further include an acceleration sensor, a gyroscope sensor, a magnetic sensor, a pressure sensor, or a temperature sensor.

The communication component 608 is configured to facilitate wired or wireless/radio communication between the device 600 and other equipment. The device 600 may access a radio network based on a communication standard such as WiFi, 2G, 3G, . . . , or a combination thereof. In an illustrative embodiment, the communication component 608 broadcasts related information or receives a broadcast signal from an external broadcast management system via a broadcast channel. In an illustrative embodiment, the communication component 608 further includes a Near Field Communication (NFC) module for short-range communication. For example, the NFC module may be realized based on Radio Frequency Identification (RFID), Infrared Data Association (IrDA), Ultra-WideBand (UWB) technology, BlueTooth (BT) technology, and other technologies.

In an illustrative embodiment, the device 600 may be realized by one or more of Application Specific Integrated Circuits (ASIC), Digital Signal Processors (DSP), Digital Signal Processing Device (DSPD), Programmable Logic Devices (PLD), Field Programmable Gate Arrays (FPGA), controllers, microcontrollers, microprocessors or other electronic components, to implement the method.

In an illustrative embodiment, a non-transitory computer-readable storage medium including instructions, such as the memory 602 including instructions, is further provided. The instructions may be executed by the processor 610 of the device 600 to implement the method. For example, the non-transitory computer-readable storage medium may be a Read-Only Memory (ROM), a Random Access Memory (RAM), a Compact Disc Read-Only Memory (CD-ROM), a magnetic tape, a floppy disk, optical data storage equipment, etc.

A non-transitory computer-readable storage medium. When instructions in the storage medium are executed by a processor of a mobile terminal, the mobile terminal is allowed to perform any one method provided in the embodiments.

Further note that herein by "multiple", it may mean two or more. Other quantifiers may have similar meanings. A term "and/or" may describe an association between associated objects, indicating three possible relationships. For example, by A and/or B, it may mean that there may be three cases, namely, existence of but A, existence of both A and B, or existence of but B. A slash mark "/" may generally denote an "or" relationship between two associated objects that come respectively before and after the slash mark. Singulars "a/an", "said" and "the" are intended to include the plural form, unless expressly illustrated otherwise by context.

Further note that although in drawings herein operations are described in a specific or der, it should not be construed as that the operations have to be performed in the specific or der or sequence, or that any operation shown has to be performed in or der to acquire an expected result. Under a specific circumstance, multitask and parallel processing may be advantageous.

Other embodiments of the invention will be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as illustrative only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. A method, comprising:

acquiring an original noisy signal of each of at least two microphones by acquiring, using the at least two microphones, an audio signal emitted by each of at least two sound sources;

for each frame in time domain, acquiring an estimated frequency-domain signal of each of the at least two sound sources according to the original noisy signal of each of the at least two microphones;

determining a frequency collection containing a plurality of predetermined static frequencies and dynamic frequencies in a predetermined frequency band range, the dynamic frequencies being frequencies whose frequency data meeting a filter condition;

determining a weighting coefficient of each frequency contained in the frequency collection according to the estimated frequency-domain signal of the each frequency in the frequency collection;

determining a separation matrix of the each frequency according to the weighting coefficient; and acquiring, based on the separation matrix and the original noisy signal, the audio signal emitted by each of the at least two sound sources.

2. The method of claim 1, wherein determining the frequency collection containing the plurality of the predetermined static frequencies and the dynamic frequencies in the predetermined frequency band range comprises:

determining a plurality of harmonic subsets in the predetermined frequency band range, each of the harmonic subsets containing a plurality of frequency data, frequencies contained in the plurality of the harmonic subsets being the predetermined static frequencies;

determining a dynamic frequency collection according to a condition number of an a priori separation matrix of the each frequency in the predetermined frequency band range, the a priori separation matrix comprising: a predetermined initial separation matrix or a separation matrix of the each frequency in a last frame; and determining the frequency collection according to a union of the harmonic subsets and the dynamic frequency collection.

3. The method of claim 2, wherein determining the plurality of the harmonic subsets in the predetermined frequency band range comprises:

determining, in each frequency band range, a fundamental frequency, first M of frequency multiples, and frequencies within a first preset bandwidth where each of the frequency multiples is located; and determining the harmonic subsets according to a collection consisting of the fundamental frequency, the first M of the frequency multiples, and the frequencies within the first preset bandwidth where the each of the frequency multiples is located.

4. The method of claim 3, wherein determining, in the each frequency band range, the fundamental frequency, the first M of the frequency multiples, and the frequencies within the first preset bandwidth where the each of the frequency multiples is located comprises:

determining the fundamental frequency of the each of the harmonic subsets and the first M of the frequency multiples corresponding to the fundamental frequency of the each of the harmonic subsets according to the predetermined frequency band range and a predetermined number of the harmonic subsets into which the predetermined frequency band range is divided; and determining the frequencies within the first preset bandwidth according to the fundamental frequency of the each of the harmonic subsets and the first M of the frequency multiples corresponding to the fundamental frequency of the each of the harmonic subsets.

5. The method of claim 2, wherein determining the dynamic frequency collection according to the condition number of the a priori separation matrix of the each frequency in the predetermined frequency band range comprises:

determining the condition number of the a priori separation matrix of the each frequency in the predetermined frequency band range;

determining a first-type ill-conditioned frequency with a condition number greater than a predetermined threshold;

determining, as second-type ill-conditioned frequencies, frequencies in a frequency band centered on the first-type ill-conditioned frequency and having a bandwidth of a second preset bandwidth; and determining the dynamic frequency collection according to the first-type ill-conditioned frequency and the second-type ill-conditioned frequencies.

6. The method of claim 1, wherein determining the weighting coefficient of the each frequency contained in the frequency collection according to the estimated frequency-domain signal of the each frequency in the frequency collection comprises:

determining, according to the estimated frequency-domain signal of the each frequency in the frequency collection, a distribution function of the estimated frequency-domain signal; and determining, according to the distribution function, the weighting coefficient of the each frequency.

7. The method of claim 6, wherein determining, according to the estimated frequency-domain signal of the each frequency in the frequency collection, the distribution function of the estimated frequency-domain signal comprises:

determining a square of a ratio of the estimated frequency-domain signal of the each frequency in the frequency collection to a standard deviation;

determining a first sum by summing over the square of the ratio of the frequency collection in each frequency band range;

acquiring a second sum as a sum of a root of the first sum corresponding to the frequency collection; and determining the distribution function according to an exponential function that takes the second sum as a variable.

8. The method of claim 6, wherein determining, according to the estimated frequency-domain signal of the each frequency in the frequency collection, the distribution function of the estimated frequency-domain signal comprises:

determining a square of a ratio of the estimated frequency-domain signal of the each frequency in the frequency collection to a standard deviation;

determining a third sum by summing over the square of the ratio of the frequency collection in each frequency band range;

determining a fourth sum according to the third sum corresponding to the frequency collection to a predetermined power;

determining the distribution function according to an exponential function that takes the fourth sum as a variable.

9. A device, comprising:

at least one processor and a memory for storing executable instructions executable by the at least one processor, wherein when the at least one processor is used to execute the executable instructions, the executable instructions execute a method for processing an audio signal, the method comprising:

acquiring an original noisy signal of each of at least two microphones by acquiring, using the at least two microphones, an audio signal emitted by each of at least two sound sources;

for each frame in time domain, acquiring an estimated frequency-domain signal of each of the at least two sound sources according to the original noisy signal of each of the at least two microphones;

determining a frequency collection containing a plurality of predetermined static frequencies and dynamic frequencies in a predetermined frequency band range, the dynamic frequencies being frequencies whose frequency data meeting a filter condition;

determining a weighting coefficient of each frequency contained in the frequency collection according to the estimated frequency-domain signal of the each frequency in the frequency collection;

determining a separation matrix of the each frequency according to the weighting coefficient; and acquiring, based on the separation matrix and the original noisy signal, the audio signal emitted by each of the at least two sound sources.

10. The device of claim 9, wherein the at least one processor implements determining the frequency collection containing the plurality of the predetermined static frequencies and the dynamic frequencies in the predetermined frequency band range by:

determining a plurality of harmonic subsets in the predetermined frequency band range, each of the harmonic subsets containing a plurality of frequency data, frequencies contained in the plurality of the harmonic subsets being the predetermined static frequencies;

determining a dynamic frequency collection according to a condition number of an a priori separation matrix of the each frequency in the predetermined frequency band range, the a priori separation matrix comprising: a predetermined initial separation matrix or a separation matrix of the each frequency in a last frame; and determining the frequency collection according to a union of the harmonic subsets and the dynamic frequency collection.

11. The device of claim 10, wherein the at least one processor implements determining the plurality of the harmonic subsets in the predetermined frequency band range by:

determining, in each frequency band range, a fundamental frequency, first M of frequency multiples, and frequencies within a first preset bandwidth where each of the frequency multiples is located; and determining the harmonic subsets according to a collection consisting of the fundamental frequency, the first M of the frequency multiples, and the frequencies within the first preset bandwidth where the each of the frequency multiples is located.

12. The device of claim 11, wherein the at least one processor implements determining, in the each frequency band range, the fundamental frequency, the first M of the frequency multiples, and the frequencies within the first preset bandwidth where the each of the frequency multiples is located, by:

determining the fundamental frequency of the each of the harmonic subsets and the first M of the frequency multiples corresponding to the fundamental frequency of the each of the harmonic subsets according to the predetermined frequency band range and a predetermined number of the harmonic subsets into which the predetermined frequency band range is divided; and determining the frequencies within the first preset bandwidth according to the fundamental frequency of the each of the harmonic subsets and the first M of the frequency multiples corresponding to the fundamental frequency of the each of the harmonic subsets.

13. The device of claim 10, wherein the at least one processor implements determining the dynamic frequency collection according to the condition number of the a priori separation matrix of the each frequency in the predetermined frequency band range by:

determining the condition number of the a priori separation matrix of the each frequency in the predetermined frequency band range;

determining a first-type ill-conditioned frequency with a condition number greater than a predetermined threshold;

determining, as second-type ill-conditioned frequencies, frequencies in a frequency band centered on the first-type ill-conditioned frequency and having a bandwidth of a second preset bandwidth; and determining the dynamic frequency collection according to the first-type ill-conditioned frequency and the second-type ill-conditioned frequencies.

14. The device of claim 9, wherein the at least one processor implements determining the weighting coefficient of the each frequency contained in the frequency collection according to the estimated frequency-domain signal of the each frequency in the frequency collection by:

determining, according to the estimated frequency-domain signal of the each frequency in the frequency collection, a distribution function of the estimated frequency-domain signal; and determining, according to the distribution function, the weighting coefficient of the each frequency.

15. The device of claim 14, wherein the at least one processor implements determining, according to the estimated frequency-domain signal of the each frequency in the frequency collection, the distribution function of the estimated frequency-domain signal, by:

determining a square of a ratio of the estimated frequency-domain signal of the each frequency in the frequency collection to a standard deviation;

determining a first sum by summing over the square of the ratio of the frequency collection in each frequency band range;

acquiring a second sum as a sum of a root of the first sum corresponding to the frequency collection; and determining the distribution function according to an exponential function that takes the second sum as a variable.

16. The device of claim 14, wherein the at least one processor implements determining, according to the estimated frequency-domain signal of the each frequency in the frequency collection, the distribution function of the estimated frequency-domain signal, by:

determining a square of a ratio of the estimated frequency-domain signal of the each frequency in the frequency collection to a standard deviation;

determining a third sum by summing over the square of the ratio of the frequency collection in each frequency band range;

determining a fourth sum according to the third sum corresponding to the frequency collection to a predetermined power;

determining the distribution function according to an exponential function that takes the fourth sum as a variable.

17. A non-transitory computer-readable storage medium, having stored thereon computer-executable instructions which, when executed by a processor, implement a method for processing an audio signal, the method comprising:

acquiring an original noisy signal of each of at least two microphones by acquiring, using the at least two microphones, an audio signal emitted by each of at least two sound sources;

for each frame in time domain, acquiring an estimated frequency-domain signal of each of the at least two sound sources according to the original noisy signal of each of the at least two microphones;

determining a frequency collection containing a plurality of predetermined static frequencies and dynamic frequencies in a predetermined frequency band range, the dynamic frequencies being frequencies whose frequency data meeting a filter condition;

determining a weighting coefficient of each frequency contained in the frequency collection according to the estimated frequency-domain signal of the each frequency in the frequency collection;

determining a separation matrix of the each frequency according to the weighting coefficient; and acquiring, based on the separation matrix and the original noisy signal, the audio signal emitted by each of the at least two sound sources.

18. The non-transitory computer-readable storage medium of claim 17, wherein determining the frequency collection containing the plurality of the predetermined static frequencies and the dynamic frequencies in the predetermined frequency band range comprises:

determining a plurality of harmonic subsets in the predetermined frequency band range, each of the harmonic subsets containing a plurality of frequency data, frequencies contained in the plurality of the harmonic subsets being the predetermined static frequencies;

determining a dynamic frequency collection according to a condition number of an a priori separation matrix of the each frequency in the predetermined frequency band range, the a priori separation matrix comprising: a predetermined initial separation matrix or a separation matrix of the each frequency in a last frame; and determining the frequency collection according to a union of the harmonic subsets and the dynamic frequency collection.

19. The non-transitory computer-readable storage medium of claim 18, wherein determining the plurality of the harmonic subsets in the predetermined frequency band range comprises:

determining, in each frequency band range, a fundamental frequency, first M of frequency multiples, and frequencies within a first preset bandwidth where each of the frequency multiples is located; and determining the harmonic subsets according to a collection consisting of the fundamental frequency, the first M of the frequency multiples, and the frequencies within the first preset bandwidth where the each of the frequency multiples is located.

20. The non-transitory computer-readable storage medium of claim 19, wherein determining, in the each frequency band range, the fundamental frequency, the first M of the frequency multiples, and the frequencies within the first preset bandwidth where the each of the frequency multiples is located comprises:

determining the fundamental frequency of the each of the harmonic subsets and the first M of the frequency multiples corresponding to the fundamental frequency of the each of the harmonic subsets according to the predetermined frequency band range and a predetermined number of the harmonic subsets into which the predetermined frequency band range is divided; and determining the frequencies within the first preset bandwidth according to the fundamental frequency of the each of the harmonic subsets and the first M of the frequency multiples corresponding to the fundamental frequency of the each of the harmonic subsets.

* * * * *